US005415963A

United States Patent [19]

Toya et al.

[11] Patent Number: 5,415,963

[45] Date of Patent: May 16, 1995

[54] PLURAL COLOR TONERS, DEVELOPERS COMPRISING THE SAME, IMAGE-FORMING METHOD USING THE PLURAL TONERS, AND IMAGE-FORMING SYSTEM THEREFOR

[75] Inventors: Kenzo Toya, Okazaki; Sanji Inagaki, Toyokawa; Shoichi Tsuge, Okazaki; Mineyuki Sako, Toyohashi, all of Japan

[73] Assignee: Minolta Camera Kabushiki Kaisha, Osaka, Japan

[21] Appl. No.: 43,910

[22] Filed: Apr. 7, 1993

[30] Foreign Application Priority Data

| | | | |
|---|---|---|---|
| Apr. 7, 1992 | [JP] | Japan | 4-085259 |
| Jun. 10, 1992 | [JP] | Japan | 4-150489 |
| Jun. 10, 1992 | [JP] | Japan | 4-150490 |

[51] Int. Cl.[6] ..... G03G 9/00

[52] U.S. Cl. ..... 430/106; 430/105; 430/107; 430/111

[58] Field of Search ..... 430/106, 105, 107, 111

[56] References Cited

U.S. PATENT DOCUMENTS 4,254,201 3/1981 Sawai et al. ..... 430/111

FOREIGN PATENT DOCUMENTS 62-17753 1/1987 Japan .

*Primary Examiner*—Mark A. Chapman

*Attorney, Agent, or Firm*—Burns, Doane, Swecker & Mathis

[57] ABSTRACT

The present invention relates to plural color toners for use in image-forming method of forming images cyclically with the toners, developers comprising the toners and image-forming method by use of the toners or developers and image-forming system therefor, and is characterized in that use is made of toners which have their surfaces in a substantially identical state.

30 Claims, 5 Drawing Sheets

PLURAL COLOR TONERS, DEVELOPERS COMPRISING THE SAME, IMAGE-FORMING METHOD USING THE PLURAL TONERS, AND IMAGE-FORMING SYSTEM THEREFOR

BACKGROUND OF THE INVENTION

1. Field of the Invention

The present invention relates to plural developers or toners each of which contains different materials, an image-forming method by use of them and an image-forming system therefor.

Particularly, it relates to monocolor toners each of which contains different coloring agents, developers comprising these toners, a color-image forming method for forming color images by use of these toners or developers and a color image-forming system therefor.

2. Description of the Prior Art

Recently, as information for an office and a person are increasing, color copy is sought in the electrophotographic field.

For example, sought are electrophotographic copying machine which can form exact full-color images from a manuscript, or copying machines, printers, facsimiles and the like of digital or analog type having multicolor function, business-color function and the like in order to provide such color images from the necessary parts as demanded by the operator.

In these image-forming systems, a visible image is formed by electrophotography by use of plural monocolor developers or monocolor toners. Such developers and toners comprise for optimization of their performance various additives e.g. charge controlling agents (various dyes, metal complexes, etc.), magnetic powders and fluidity improvers (various oxides, nitrides, etc.). It goes without saying that in forming multi-color images, these developers or toners contain different coloring agents respectively or they are constituted of different binder resins respectively.

When plural of toners or developers containing various materials are utilized in an image-forming process, optimal image-forming conditions are different from one toner or developer to the other, giving rise to troubles such as difficulty in control and unstable picture quality and so on. Further, variation in their image-forming performance under environmental fluctuation differs from one toner or developer to the other, resulting in image instability under varying environmental conditions, even after their performance is adjusted under a definite environment. Or even under identical environmental conditions, different corrections are required between individual toners or developers in the course of their continuous use because of the difference in durability from one toner or developer to the other.

Recently known is a technique in which plural coloring agents are contained in a developer or toner. This developer or toner has difficulty to control because of different electrification performance from one coloring agent to the other or gives unstable picture quality. Such a trouble widely occurs notably in image-forming methods making use of plural/single toner(s) or developer(s) containing various coloring agents and the system used therefor. Even if a coloring agent is used in common, the other materials contained therein are different and the above trouble is brought about. When developers or toners containing a coloring agent in common are utilized in one system, the same trouble arises. For example, in the case of micro-reader/printer which makes use of 2 types of toners comprising a common coloring agent, charge controlling agents differs in electrification polarity for normal and reversal development. This poses the trouble to be resolved.

Furthermore, when toners or developers containing various kind of materials are used in an image-forming process, the individual toners or developers undergo different variations from one to the other under different environmental conditions. When the variations in use are monitored, the individual toners or developers must be monitored. For example, when an image concentration is detected automatically in forming full color images (this system is referred to as AIDC), it becomes necessary to make detection for each toner of yellow, cyan, magenta and black. This leads not only to difficulty in control but rises in cost.

SUMMARY OF THE INVENTION

It is an object of the present invention to provide a developer, toner and image-forming method and the system used therefor in which the aforementioned inconveniences have been got rid of.

Another object of this invention is to improve the performance of plural/single developer(s) or toner(s) containing various materials.

A further object of this invention is to provide a method and a system which have large tolerances for the setting ranges of optimal image-forming conditions in the image-forming method and the system used therefore.

A still another object of this invention is to provide a method and a system whose image-forming performance is insusceptible to change under fluctuating environmental conditions, when the image-forming method and the system used therefor utilize plural/single developer(s) and toner(s) containing plural materials.

A still another object of this invention is to provide a method and a system whose image forming-performance is insusceptible to change in its continuous use, when the image-forming method and the system used therefor make use of plural/single developer(s) or toner(s) containing plural materials.

A still another object of this invention is to provide an image-forming method and a system used therefor which permit easy monitoring of the image-forming situation in the image-forming method and the system used therefor which make use of plural/single developer(s) or toner(s) containing plural materials.

The present inventors found out that the major factor responsible for the aforementioned inconvenience is the difference in the surface state of the developers or toners which gives rise to the difference in their electrification performance.

Accordingly, it is the object of the present invention to provide developers or toners which have nearly identical surface properties, in particular, electrification characteristics.

Therefore, it is the object of this invention to provide an image-forming method and the system used therefor which permit stable electrification performance to be continuously maintained by use of the said developers or toners.

The above objects can be achieved by toners and developers having a common surface state.

The present invention relates to plural color toners for use in image-forming method of forming images cyclically with the toners, developers comprising the toners and image-forming method by use of the toners or developers and image-forming system therefor, and is characterized in that use is made of toners which have their surfaces in a substantially identical state.

When multiple types of developers or toners containing various kinds of materials are researched and developed or when an image-forming method and the system used therefor which make use of the toners and the developers are researched and developed, it has become possible to research and develop such the developers, the toners, the image-forming method and the system used therefor in a very short period of time.

DETAILED DESCRIPTION OF THE INVENTION

The present invention provides toners or developers containing the toners each of which undergo identical variations in the amount of electrification under varying environmental conditions and which give stable adhesion of respective color toners, the respective toners being of different colors and containing different coloring agents.

This invention also provides toners which are capable of meeting in a short time the demand for toners which are adaptable for multi-item and small lot production and which can be mixed to produce any desired colors.

Further it provides an image-forming method and the system used therefor which make use of plural the aforementioned toners.

Figure 1:
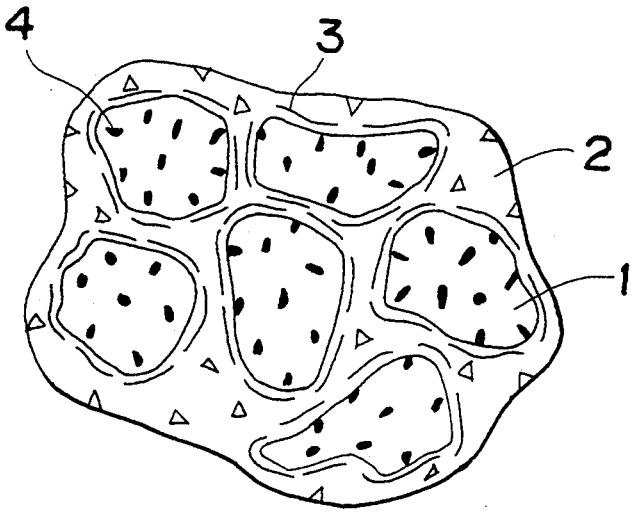
FIG. 1 is a schematic sectional view of a toner used according to this invention.

This invention can be achieved by substantially equalizing the states of exposed surfaces of respective color toners. Such a toner may be obtained by composing it as shown in FIG. 1. Thus the toner of this invention comprises at least a domain-resin composition 1, a matrix-resin composition 2 which is low in compatibility with the domain resin and a dispersing assistant 3 which is compatible with both the domain and matrix resins and which has a higher Izod impact value than that of the matrix resin, the domain-resin composition being dispersed in the matrix-resin composition with the dispersing assistant interposed therebetween. The reference number 4 shows a coloring agent. The reference number shows a charge controlling agent, added if desired.

The dispersing assistant phase is covering at least part of the domain resin phase. Used as a dispersing assistant and the matrix resin are resins having definitely different impact resistances between them, whereby effective protection of the domain resin from breakage is assured in the pulverizing step. Therefore, the coloring agent is confined in the domain resin, without being exposed at the toner particle surfaces, to achieve stabilized electrification. Further, the existence of such a dispersing assistant deters overpulverizing, resulting in high producing efficiency.

The matrix resins of the toners composing the electrophotographic developers of this invention include homo- or co-polymers of α-olefines (including ethylene) such as ethylene, propylene, butene-1, pentene-1, 4-methyl pentene-1 and hexane-1, block, random or graft copolymers of more than half by weight of these α-olefins with other unsaturated compounds, modified olefinic polymers which are formed from the above homo- or co-polymers by halogenation, sulfonation, oxidation and so forth, acrylonitrile-styrene copolymers (AS resin), polycarbonates, thermoplastic polyesters, polyamides, polystyrenes, styrene-butadiene-styrene block copolymers, polyacrylonitrile, polymethyl methacrylate and rubber and the like thermoplastic polymers.

Said unsaturated compounds which are copolymerizable with the α-olefins are vinyl esters such as vinyl acetate and like, vinyl silanes such as vinyl trimethoxysilane and vinyl triethyoxysilane, and ethylenic unsaturated monomers other than the above-illustrated α-olefins.

As the thermoplastic polymers used according to this invention, polyesters and polystyrenes are preferable for the matrix resin.

The polyesters preferably used according to this invention are appropriately selected from among those obtained by polycondensation of typically used polybasic acids and polyhydric alcohols.

The polybasic acids include aromatic carboxylic acids such as terephthalic acid, isophthalic acid and trimellitic acid, aliphatic carboxylic acids such as adipic acid, hexahydroterephthalic acid, succinic acid, n-dodecenyl succinic acid, isododecenyl succinic acid, n-dodecyl succinic acid, n-octyl succinic acid, isooctyl succinic acid and n-butyl succinic acid, unsaturated carboxylic acids such as maleic acid fumaric acid, and their anhydrides. The polyhydric alcohols include ethylene glycol, propylene glycol, 1,4-butanediol, hexamethylene glycol, neopentyl glycol, 2,2,4,4-tetramethylene glycol, glycerine, trimethylol propane, bisphenol A, hydrogenated bisphenol A, sorbitol or their etherized hydroxyl compounds such as polyoxyethylene (10) sorbitol, polyoxypropylene (5) glycerine, polyoxyethylene (4) pentaerythritol, polyoxypropylene(2,2)-2,2-bis(4-hydroxyphenyl)propane and polyoxyethylene(2)-2,2-bis(4-hydroxyphenyl)propane.

More preferable polyesters are those soluble in solvents. Those noncrystalline or slightly crystalline, particularly those having less than 5% crystallinity, as determined by X-ray analysis, have large effect. With regard to the softening point, those having 40°–150° C., particularly 60°–150° C., have large effect and with regard to the number average molecular weight (Mn), those having 500–30000, particularly 1000–20000 have large effect.

Polystyrenes preferably used according to this invention are polystyrene or those formed by copolymerizing with styrene any of unsaturated copolymerizable monomers e.g. unsaturated carboxylic acids such as acrylic acid and methacrylic acid, unsaturated carboxylates such as methylacrylate, ethyl acrylate, methyl methacrylate, n-butyl methacrylate, dibutyl fumarate and dioctyl fumarate, unsaturated carboxylic anhydrides such as maleic anhydride and itaconic anhydride, and derivatives thereof, in the range below half thereof. Among them those having 30°–105° C. of glass transition points and 1000–150000 of Mn, particularly 2000–100000 of Mn, have large effect.

As the polystyrenes used according to this invention, those soluble in solvents are especially preferable.

Such a matrix resin should exist in an amount sufficient to substantially coat the dispersed domain-resin component. Thus they are usable in wide ranges in respective toners. In general it should preferably be used at 20–99% by weight, more preferably 30–95% by weight, of the toner resin. If its amount is less than the aforementioned range, the matrix resin and the domain resin undergo phase reversal. As a result, the coloring agent-containing resin is exposed after pulverization, causing improper electrification and tending to overpulverizing. This results in spreading particle size distribution, improper dispersion and lowered manufacturing efficiency. Its amount in excess of the aforementioned range will invite improper dispersion of the coloring agent into the matrix resin.

While similar resins as those of the aforementioned matrix resin may be applied to the domain resin. The domain resin, however, should be made not evenly compatible with the matrix resin by using comonomers to be copolymerized to change its compatibility with the matrix resin. In this way the domain resin can be dispersed in the matrix resin.

The coloring agent used in the toner for the electrophotographic developer of this invention is dispersed in and held by the domain resin and this domain resin is dispersed in the matrix resin, whereby the exposure of the coloring agent at the toner surface is prevented. Thus the materials of the exposed surface can be made substantially identical to those of other toners even if the toners have different types of coloring agents.

That is to say, in the toner composition of this invention, the matrix resin and the domain resin are not uniformly compatible with each other and the one having larger affinity for the coloring agent should serve as the domain resin.

The dispersing assistant used in the toner of this invention is a copolymer containing the domain resin component and the matrix resin component. The one obtained by graft-copolymerizing a resin containing monomers which compose one of the domain or matrix resin with monomers composing the other resin is preferable.

The dispersing assistant used according to this invention acts to finely disperse the domain resin into the matrix resin. Its 1% by weight or more, if present in the toner composition, will make the dispersion phase sufficiently fine and uniform. It should preferably be used at 3% by weight or more.

The dispersing assistant used should have an Izod impact value of 0.1 kgf·cm/cm$^2$ or more, preferably 0.2 kgf·cm/cm$^2$ or more, more preferably 0.4 kgf·cm/cm$^2$ or more higher than that of the matrix resin. By using such a resin, the matrix phase is preferentially broken in the pulverizing process, thereby preventing the breakage of the domain resin. Accordingly, the coloring agent is left confined in the domain resin phase, thereby making it possible to prevent exposure of the coloring agent at the toner surface. If its Izod impact value is smaller than the aforementioned range, the domain resin also tends to be stressed, thereby becoming vulnerable to breakage. Once the domain resin phase is broken, the coloring agent is exposed, making it impossible to make the materials of their exposed surfaces substantially identical between different toners.

In connection with this invention, the Izod impact value is represented by the value obtained by measurement by use of a Mini-max Izod impact tester (Model CS-183; made by Instrument K.K.). In taking this measurement, a test piece of 30×12×2.0 [mm] is prepared by press molding (conditions: 130° C., 60–70 kg/cm$^2$) and this test piece is placed on the tester.

Actual examples of the method for preparing the dispersing assistant by graft reaction of styrenic polymer with vinyl monomer include (1) a method of making the reaction with vinyl monomer added to a solution of the polymer dissolved in a solvent, (2) a method of making the reaction with the polymer dissolved in vinyl monomer, (3) a method of making the reaction, after suspending polymer particles in water and then adding vinyl monomer thereto, thereby to impregnate the polymer particles with it, (4) a method of making the reaction, with the polymer dissolved in vinyl monomer in the state of being floated as liquid drops in water, (5) a method of making the reaction of the polymer in melt state with vinyl monomer and (6) radiation-grafting method, etc. Among these methods, preferable methods are those of (3) or (4) mentioned above. In the polymer obtained by the method of (3) or (4), the matrix resin and the domain resin are simultaneously contained and formed, so that the product may be used without separately adding the matrix or domain resin.

In performing this reaction, normally a polymerization initiator is used. As the polymerization initiator, generally those for use in radical polymerization may be used, but it is preferable to choose it from those having a decomposition temperature of 45°–110° C., particularly 50°–105° C., in view of the temperature of the polymerization reaction. The decomposition temperature means the temperature when the decomposition ratio of the radical generator is 50% after a solution added with 0.1 mole of the polymerization initiator in 1 liter of benzene was left to stand for 10 hours.

Such initiators that may be mentioned as practical examples include organic peroxides such as 2,4-dichloro-benzoyl peroxide (54° C.) (the temperature in parenthesis designates the decomposition temperature), tert-butyl peroxypivalate (56° C.), o-methyl benzoyl peroxide (57° C.), bis-3,5,5-trimethyl hexanoyl peroxide (60° C.), octanoyl peroxide (61° C.), lauroyl peroxide (62° C.), benzoyl peroxide (74° C.), tert-butyl peroxy-2-ethyl hexanoate (74° C.), 1,1-bis(tert-butyl peroxy)-3,5,5-trimethyl cyclohexane (91° C.), cyclohexanone peroxide (97° C.), 2,5-dimethyl-2,5-dibenzoyl peroxyhexane (100° C.), tert-butyl peroxybenzoate (104° C.), di-tert-butyl-diperoxyphthalate (105° C.), methyl ethyl ketone peroxide (109° C.), dicumyl peroxide (117° C.), dicumyl-tert-butyl peroxide. These compounds may be jointly used.

The amount of the polymerization initiator to be used should fall in the range of 0.05–30% by weight, preferably 0.1–10% by weight, of vinyl monomer.

According to this invention, the dispersing assistant may be obtained by graft-polymerizing in situ a monomer which can form the matrix resin (e.g. polyester) and a monomer (e.g. styrene) which can form the domain resin.

Usable coloring agents to be contained in the toners are not particularly limited, but include well-known ones e.g. carbon black, azo dyes, titanium oxide and other various dyes and pigments. As substantial total amount of the coloring agent is dispersed and filled into the domain resin, the coloring agent to be used should have larger affinity for the domain resin than for the matrix resin.

Generally in the electrophotographic copying system, there is employed a mechanism for automatically supplementing the amount of the toner that has decreased by a predetermined rate as the toner in the developing machine has been consumed. In the developing system for full color, there is employed a mechanism for supplementing the decreased amount of the toner upon detection of the toner concentration in the developing machine, taking advantage of the spectroscopic characteristic (reflection characteristic) to near infrared light of the coloring agent contained in the toner. In the case of a black toner containing carbon black as coloring agent, the carbon black absorbs nearly 100% of near infrared light. The black toner can not be detected using near infrared light. Thus the black toner containing the conventional carbon black can not be used as a black toner for full color. On this account, the black toner for use in the full color developing system should be composed of a mixture of three coloring agents of magenta, cyan and yellow which give spectroscopic characteristics to near infrared light. When a black color is produced by mixing the three coloring agents, it turns bluish black, if each coloring agent is not uniformly dispersed. As it is difficult to make uniform dispersion particularly by a melting and kneading method, it is difficult to achieve pure black.

The toners used for electrophotography are prepared generally by kneading a coloring agent etc. with a matrix resin which serves as a binder, pulverizing the kneaded matter and classifying the pulverized matter to adjust their particle size distribution to specified one.

The toner obtained by the pulverizing process in this way has the coloring agent nonuniformly exposed at its surface. The coloring agents, because of their low humidity and environmental resistance, raise problems in individual toners' uniformity and in their amount of electrification, and storage and environmental stability etc. Further, separation of coloring agent and its adhesion on the carrier surface cause unstable chargeability.

In this connection this invention provides for the benefit of more preferable mode of its application a black toner for use of full color which contains the coloring agent with surface exposure restrained and which is excellent in electrification characteristic and stability (humidity, printing, environmental and storage resistance) and also in tint.

Thus a more preferable black toner in the present invention is a black toner for use of full color which comprises a domain-resin composition containing a black coloring agent comprising in mixture respective coloring agents of at least yellow, cyan and magenta, a matrix-resin composition having low compatibility with the domain resin and a dispersing assistant which is compatible with both the domain resin and the matrix rein and which has an Izod impact value higher than that of the matrix resin, the domain-resin composition being dispersed in the matrix-resin composition, with the dispersing assistant interposed therebetween.

This black toner is obtained by a production method comprising (a) a step of obtaining a kneaded matter prepared by melting and kneading the domain resin and a black coloring agent composed of in mixture at least yellow, cyan and magenta, (b) a step of obtaining a colored composition by melting and kneading the kneaded matter obtained by the step of (a), the matrix resin having low miscibility with the domain resin, and the dispersing assistant which is compatible with both the domain and matrix resins and which has an Izod impact value higher than that of the matrix resin, and (c) a step of pulverizing and classifying the kneaded matter obtained by the step of (b).

In the constitution of the black toner for use of full color according to this invention, the coloring agent 4 in reference to FIG. 1 is a black coloring agent comprising in mixture at least yellow, cyan and magenta coloring agents.

The black coloring agent for use in the more preferable black toner of this invention comprises in mixture at least yellow, cyan and magenta coloring agents.

There are mentioned as yellow coloring agents, C.I. pigment yellow 12, C.I. pigment yellow 13 etc.; as magenta (red) coloring agents, C.I. pigment red 122, C.I. pigment red 57:1 etc.; as cyan (blue) coloring agent, C.I. pigment blue 15 etc. But the usable coloring agents are not limited to them. Any of various color pigments and dyes conventionally used in transparent color toners are usable.

The mixing proportion of the respective colors of yellow, magenta and cyan may be so selected as to give the desired black color.

As for their mixing method, the coloring agents of yellow, magenta and cyan and the domain resin may be simultaneously mixed by a melting and kneading method. The domain resin may be mixed with the black coloring agent prepared in advance by mixing the respective coloring agents of yellow, magenta and cyan.

The black coloring agent composed of respective yellow, magenta and cyan coloring agents in mixture is used in a range of 3–50% by weight, preferably 5–25% by weight of the toner finally obtained. If its amount is less than 3% by weight, adequate concentration is not obtained even with a large amount of the developer. If it is larger than 50% by weight, possibility of the domain being broken at the time of pulverizing the toner is high. Then the coloring agent will be exposed at the toner surface, causing improper electrification. Besides because of the small proportion of the matrix resin, its fixing performance is poor.

Since it is necessary to disperse and fill the substantial total amount of the coloring agent into the domain resin, the coloring agent used should have larger affinity for the domain resin than for the matrix resin.

To the toners composing the developers of this invention, may be further added low molecular weight olefinic polymers, colloidal silica, fatty acids and metal salts of fatty acids and the like for the purpose of modifying their fluidity, mold releasability and so on.

For the toners of this invention, it is proper to select the component compositions according to their uses as one-component toners or as two-component developers which is used together with carriers. Basically they may be prepared through the undermentioned steps:

(1) A step of obtaining a kneaded matter by melting and kneading the domain resin and the coloring agent.

(2) A step of obtaining a kneaded matter by melting and kneading the matrix resin which has low compatibility with the domain resin with a charge controlling agent.

(3) A step of obtaining a colored composition by melting and kneading the kneaded matter obtained by the step (1), the kneaded matter obtained by the step (2) and a dispersing assistant which is compatible with both the domain and matrix resins and which has an Izod impact value higher than the matrix resin, and (4) A process of pulverizing and classifying the kneaded matter obtained by the step (3).

Since the impact resistance of the dispersing assistant phase is set higher than that of the matrix phase, possible breakage of the dispersing assistant phase and the domain resin phase in the pulverizing process, when producing the toner, is effectively prevented. Accordingly, breakage occurs in the matrix resin phase only, so that the surface of the pulverized matter or the surface of the toner obtained is substantially formed only of the matrix resin phase containing the charge controlling agent. This is because the substantial total amount of the coloring agent is contained in the domain resin phase and the stress of pulverization concentrates in the matrix phase, to have the matrix phase form the surface phase, so that the respective coloring agents in the domain phase will not be exposed at the surface. Accordingly, even if the type and color of the coloring agent are altered in many ways, toners with their exposed surfaces in a substantially identical state are obtainable. The particle diameter of the dispersed phase of the domain resin in the matrix resin should preferably be 5 μm or smaller. The particle diameter herein mentioned means the average primary particle diameter (Martin's diameter) which is measured by observation of the section of the specimen by means of a microscope.

Thus a toner of the present invention is usually obtained to have a mean particle diameter of 5–20 μm, preferably 5–10 μm.

The present invention has as its principal objects attainment of high classified yield and stabilization of electrification through prevention of exposure of coloring agents with attention focused on the breakability of the toner, but its various characteristics may be controlled by appropriately adding other additives e.g. charge controlling agents, fluidizing agents etc. into the matrix or domain resin and such modes are also covered by this invention.

The present invention will be particularly described in connection with its preferred embodiments, without however being limited thereto.

Example 1

The domain resin, matrix resin and the dispersing assistant used in this embodiment are listed as follows:

Domain resin Styrene-acrylate copolymer
MW: 53000
Izod impact strength: 0.51 [kgf·cm/cm$^2$]
Matrix resin Styrene-maleic anhydride copolymer
MW: 10000
Izod impact strength: 0.17 [kgf·cm/cm$^2$]
Dispersing assistant Modified styrene polymer
Izod impact strength: 0.41 [kgf·cm/cm$^2$]
Example of manufacture of dispersing assistant Four kg of water, 80 g of tribasic calcium phosphate and 0.12 g of sodium dodecyl benzene sulfonate were put in an autoclave of a 10-liter capacity to provide an aqueous medium, to which was added a solution of 8 g of NYPER B dissolved in a mixed solution of 640 g of styrene and 160 g of n-butyl acrylate, followed by stirring. Into this mixture, 1200 g of particles of the aforementioned matrix resin (styrene copolymer) were introduced. After replacing the atmosphere inside the autoclave with nitrogen, the inside-system temperature was raised to 60° C. This temperature was maintained for 3 hr, thereby impregnating the styrene containing the aforementioned polymerization initiator into the matrix resin particles. Next 11.4 g of PERBUTYL PV was introduced into this suspension. Then the inside-system temperature was raised to 65° C. and this temperature was maintained for 2 hr, thereby initiating the polymerization on the surfaces of the styrene polymer particles. Thereafter, the system-inside temperature was raised to 90° C. and this temperature was maintained for 3 hr, to complete the polymerization.

After cooled, the content was taken out, pickled and rinsed to give 2 kg of dispersing assistant resin.

Forty-two parts by weight (hereinafter abbreviated to pbw) of the domain resin and 3 pbw of the coloring agent (Lionol Yellow FG-1310; made by Toyo Ink Seizo K.K.) were melt-kneaded in a twin extruder.

Next 52 pbw of the matrix resin and 3 pbw of a charge controlling agent (Bontron E-81; made by Orient Kagaku K.K.) were melt and kneaded in a twin extruder.

Then 45 pbw of the kneaded domain resin, 55 pbw of the kneaded matrix resin and 8 pbw of the dispersing assistant were melt and kneaded in a twin extruder to give a colored composition.

Part of this colored composition was sandwiched between a slide glass and a cover glass and turned into a thin film by heat fusion on a hot press. As this film was observed under a transmission type optical microscope, existence of a colored dispersion phase was seen. The diameter of the dispersion phase ranges from 0.5–1.0 μm. This dispersion phase was uniformly and finely dispersed in the matrix. The coloring agent was not seen in the matrix and the charge controlling agent existed only in the matrix.

The colored matter thus obtained was finely pulverized by a jet mill and thereafter a yellow toner of 11 μm average particle diameter was obtained by classification.

Further magenta, cyan and black toners of 11 μm average particle size were prepared by using coloring agent(s) set as below to be melt and kneaded with 42 pbw of the domain resin:

| | |
|---|---|
| Magenta toner | |
| Lionol Red 6B FG-4213 (made by Toyo Ink Seizo K.K.) | 3 pbw |
| Cyan toner | |
| Lionol Blue FG-7350 (made by Toyo Ink Seizo K.K.) | 3 pbw |
| Black toner | |
| Lionol Yellow FG-1310 (made by Toyo Ink Seizo K.K.) | 2 pbw |
| Lionol Red 6B FG-4213 (made by Toyo Ink Seizo K.K.) | 2 pbw |
| Lionol Blue FG-7350 (made by Toyo Ink Seizo K.K.) | 2 pbw |

As the respective colored compositions were observed by the above-mentioned method, existence of colored dispersion phase was likewise seen. In this dispersion phase, its dispersion had particle diameters ranging from 0.5–1.0 μm and was found to be uniformly and finely dispersed in the matrix. The coloring agent was not seen in the matrix and the charge controlling agent existed only in the matrix.

The colored matters thus obtained were finely pulverized by a jet mill and then classified to give magenta, cyan and black toners respectively. Each toner was 11 μm in average particle diameter.

Comparative Example 1

A colored matter was obtained by melting and kneading the listed materials below: Resin as a binder Styrene-maleic acid copolymer (same as the resin used as the matrix resin in the aforementioned example) 100 pbw

| | |
|---|---|
| Charge controlling agent | |
| Bontron E-81 (made by Orient Kagaku K.K.) | 3 pbw |
| Coloring agent | |
| Lionol Yellow FG-1310 (made by Toyo Ink K.K.) | 3 pbw |

The colored matter thus obtained was finely pulverized by a jet mill and thereafter classified to give a yellow toner of 11 μm average particle diameter.

Further magenta, cyan and black toners 11 μm average particle diameter were prepared by using coloring agent(s) set as below.

| | |
|---|---|
| Magenta toner | |
| Lionol Red 6B FG-4213 (made by Toyo Ink Seizo K.K.) | 3 pbw |
| Lionol Blue FG-7350 (made by Toyo Ink Seizo K.K.) | 3 pbw |
| Black toner | |
| Lionol Yellow FG-1310 (made by Toyo Ink Seizo K.K.) | 2 pbw |
| Lionol Red 6B FG-4213 (made by Toyo Ink Seizo K.K.) | 2 pbw |
| Lionol Blue FG-7350 (made by Toyo Ink Seizo K.K.) | 2 pbw |

Figure 2:
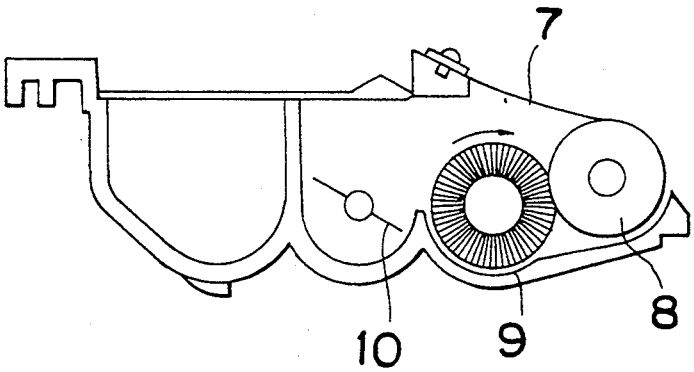
FIG. 2 is a schematic sectional view of a one-component developer.

Evaluation Measurement of amount of electrification in one-component system:

Each of the 4 color toners of Example and Comparative Example i.e. yellow, magenta, cyan and black toners was put into a developing machine (its control blade was made of SUS) for one component system shown in FIG. 2, to measure the amount of its electrification in respective environmental conditions.

In FIG. 2, toner particles are put in the space where a feed vane 10 rotates. The toner particles are stirred by a feed vane 10 in the space. After stirred for a specified time, the toner particles are provided on a brush roller 9. The toner particles on the brush roller cover the surface of a sleeve 8. The toner particles on the surface are regulated to a thin layer by a control blade 7.

The measurement was carried out by stirring the toner in the developing machine for 5 min after putting it thereinto, followed by blowing off the toner on the sleeve. The results are displayed in FIGS. 3 and 4.

Figure 3:
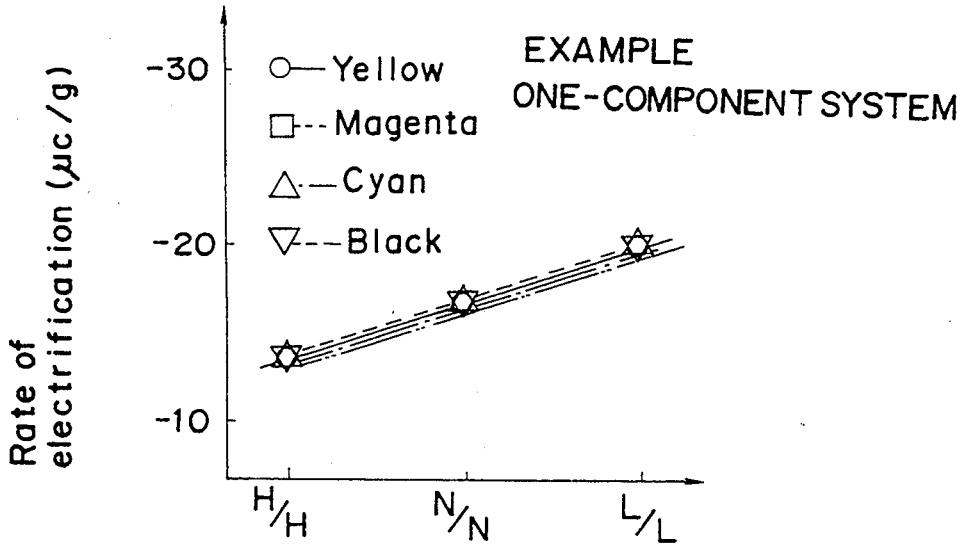
FIG. 3 shows results of measurement of the amount of electrification in respective environmental conditions.
Figure 4:
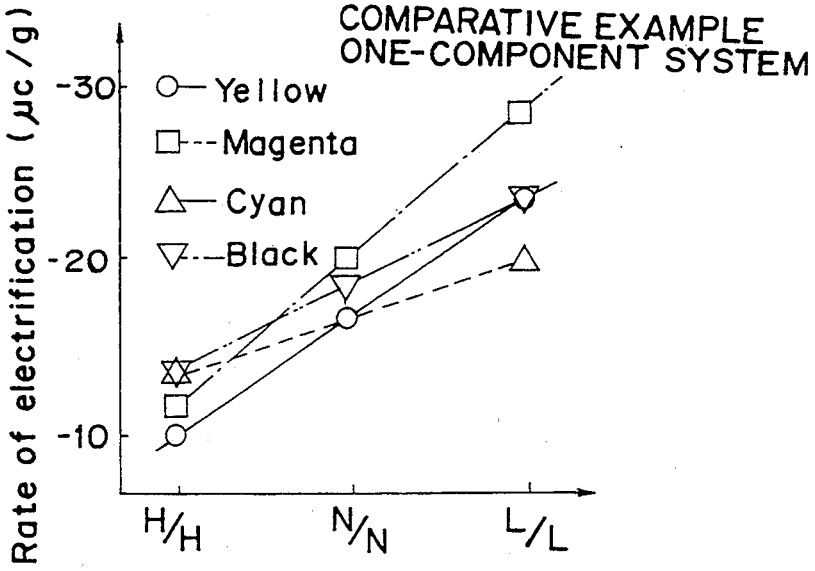
FIG. 4 shows results of measurement of the amount of electrification in respective environmental conditions.

FIGS. 3 and 4 demonstrate that while the respective color toners of Example gave identical variations in the amount of electrification, respective color toners of Comparative Example gave different variations. This is believed to be due to the fact that whereas in the toners of Comparative Example, respectively different coloring agents are exposed at their surfaces, in the toners of Example of this invention, respective coloring agents are protected and coated with the identical resin.

Measurement of amount of electrification in two-component system:

Under respective environmental conditions, each of the four color toners of Example and Comparative Example and a ferrite carrier (F141-300; made by Powdertech K.K.) were put in a poly bottle made of polypropylene. This bottle was placed on a stirring stand and after its content was stirred for 5 min, the amount of its electrification was measured. The toner concentration was 6% and the measurement of the amount of electrification was taken by means of the blow-off method. The results are shown in FIGS. 5 and 6.

Figure 5:
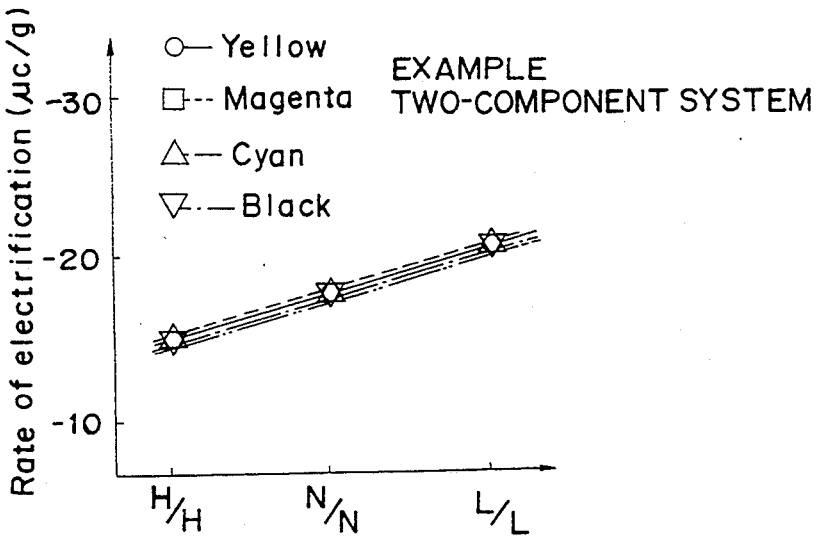
FIG. 5 shows results of measurement of the amount of electrification in respective environmental conditions.
Figure 6:
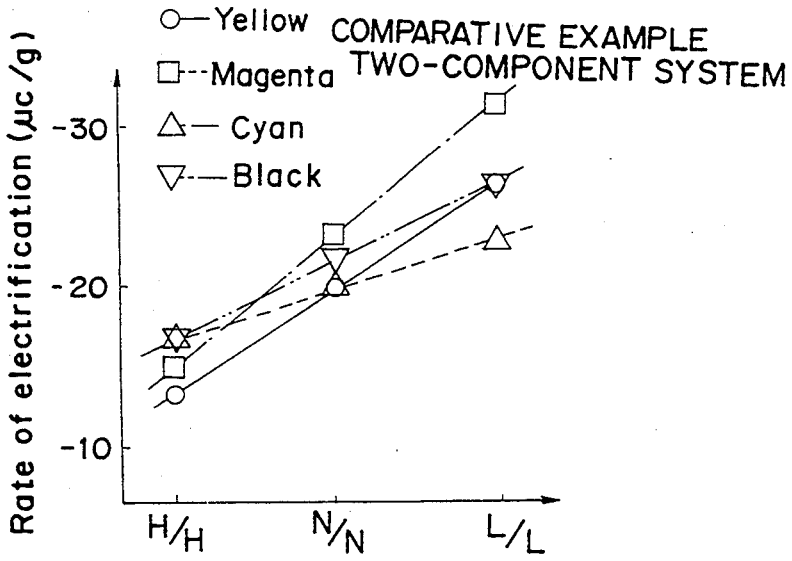
FIG. 6 shows results of measurement of the amount of electrification in respective environmental conditions.

FIGS. 5 and 6 demonstrate that whereas the respective color toners of Example gave identical variations in the amount of electrification, the respective color toners of Comparative Example gave differing variations. The reason is presumed to be similar to that in the case of the one-component system. Confirmation by use of a full color copying machine CF-70 (made by Minolta Camera K.K.)

Application of toners prepared in Example and Comparative Example to full-color copying machine CF-70 (made by Minolta Camera K.K.)

In the following, some explanation is made on CF-70. It was somewhat modified for expediency in the experiment.

Figure 7:
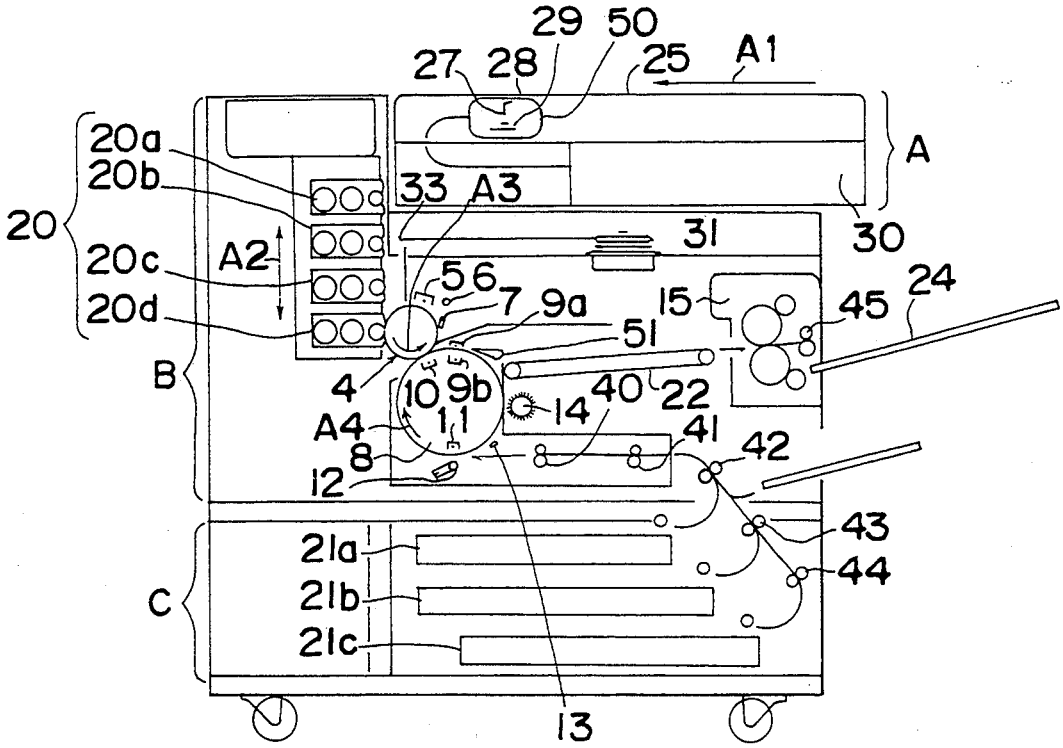
FIG. 7 is a schematic sectional view of mechanism sections of a digital-color copying machine (CF-70).

FIG. 7 is a schematic sectional view of the mechanism sections of the digital color copying machine CF-70.

This digital color copying machine is equipped with a color-image-reading section A located at the upper part, a color-printer section B placed at the intermediate part and a feeding unit C provided at the lower part. The color-image-reading section A reads the color images of the manuscript mounted on a manuscript mounting glass 26. CCD image sensor of contact type resolves color images into 3 colors of red (R), green (G) and blue (B) by a contact CCD image sensor, and then converts the read data into respective digital image signals for the three colors. The color printer B is an electrophotographic laser color printer. The printer reproduces the cyan (C), magenta (M), yellow (Y) and black (K) colors in this order at every scanning in accordance with the aforementioned digital image signals. Dot images, that are so-called digital images, are transferred to the copying paper fed from the feeding unit C plural number of times. This digital copying machine is provided with monocolor modes of forming monocolor images in 7 colors of C, M, Y, K and R, G and B.

First the color-image-reading section A will be explained:

A manuscript-scanning device 50 is provided with an exposure lamp 27 for irradiating the manuscript, a rod lens array 28 for condensing the light reflected from the manuscript and a CCD image sensor of contact type 29 for converting the condensed reflected light into electric signals of R, G and B respectively. At the time of reading the manuscript image, the manuscript-scanning device 50 scans the manuscript on the manuscript mounting glass 26 in the sub-scanning direction A1. The manuscript image irradiated by the exposure lamp 27 is photoelectrically converted by the CCD image sensor of contact type 29. The respective R, G and B electrical image signals outputted from the CCD image sensor of contact type 29 are converted by an image processing unit 30 into a digital signal for either one of C, M, Y or K. The digital signal is in turn outputted to the print head part 31 of the color printer section B.

Next the color printer section B will be described:

The print head part 31 is provided with a digital-/analog conversion (hereinafter abbreviated to D/A conversion) circuit for making D/A conversion of the print-driving digital signals outputted from the image processing unit 30, a laser diode for driving amplifier amplifying the print-driving signals which have been D/A converted, a laser diode LD which emits light in response to each of the print-driving signals, a polygon mirror (not shown) for scanning the laser beam emitted from the laser diode LD in the main scanning direction, a motor (not shown) for rotationally driving the polygon mirror and a f$\theta$ glass (not shown) for focussing the scanned laser beam on a photosensitive drum 4 through a reflection mirror 33.

The laser beams emitted from the laser diode LD inside the print head part 31 in response to the print-driving signals are scanned by the polygon mirror in the main scanning direction. Then after reflected by the reflection mirror 33, the laser beams reach onto a photosensitive drum 4. Electrostatic latent images corresponding to the manuscript images are formed on the photosensitive drum 4. Around the photosensitive drum 4, there are installed a charger 5 for uniformly charging the surface of the photosensitive drum 4 in the predetermined polarity, an eraser lamp 6 for eliminating electrical charges on the surface of the photosensitive drum, a developing system 20 for developing with use of toners the electrostatic latent images formed on the photosensitive drum 4 and a blade 7 for recovering the residual toner left untransferred to a transfer drum 8 from the photosensitive drum 4. The developing machine 20 has developing units 20*a*, 20*b*, 20*c* and 20*d* each of which contains a developer comprising a mixture of one of the respective toners mentioned above, that is, magenta, cyan, yellow and black colored toners, with a carrier. Each developing unit is movable in vertical direction, as shown by the arrow $A_2$. When, for example, the toner image of cyan is to be formed on the photosensitive drum 4, the developing unit 20*b* for cyan may be moved to the position where it is brought into touch with the photosensitive drum 4, to perform the development with the cyan toner. It should be noted that this experimental machine is so composed as to make variable the applied voltage Vb of the developing electrode (sleeve). Development by use of magenta, yellow or black toner is similarly to be performed by moving each developing unit 20*a*, 20*c* or 20*d* for respective toners to the position where each unit comes in contact with the drum 4.

This experimental machine is modified such that the mechanism can be stopped to detect an amount of the toner transferred on the photosensitive drum 4 when a toner image has been formed thereon.

A transfer drum 8 for transferring the toner image formed on the photosensitive drum 4 to copying paper is installed below the photosensitive drum 4 and in contact therewith. Around the transfer drum 8, there are installed charge-eliminating chargers 9*a* and 9*b* for eliminating electrical charges on the surface of the transfer drum 8, a transfer charger 10 for transferring the toner image formed on the photosensitive drum 4 to the transfer drum 8, an adsorption charger 11 for electrostatically adsorbing the copying paper onto the transfer drum 8, a press roller 12 for pressing the copying paper against the transfer drum 8 at the time of the electrostatic adsorption, a reference-position sensor 13 for detecting the predetermined reference position on the transfer drum 8, a fur brush 14 for recovering the toner not transferred onto the copying paper from the transfer drum 8 and a separating pawl 51 for separating the copying paper from the transfer drum 8. The photosensitive drum 4 and the transfer drum 8 are, as shown in FIG. 7, rotationally driven respectively in the directions of arrows $A_3$ and $A_4$ and synchronized to each other.

The feeding unit C is provided with three feeding trays 21*a*, 21*b* and 21*c*. The copying paper is fed from one of the feeding trays selected from among the feeding trays 21*a*, 21*b* and 21*c*. The copying paper is conveyed by conveying rollers 44, 43, 42, 41 and 40, thereafter chucked at its front end on the transfer drum 8 by dint of the feeding charger 11 and the press roller 12. After the toner image on the transfer drum 8 is transferred to the copying paper by the well-known method, the copying paper is separated from the transfer drum 8 by means of a separating pawl 51 and carried to the image fixing device 16 by a conveying belt 22. Then the copying paper on which the image has been completely fixed is discharged onto a discharge tray 24 by a discharge roller 45.

In a copying machine is used in full color mode, the respective toner images are formed on the photosensitive drum 4 in the order of cyan, magenta, yellow and black. These toner images are superposed on the copying paper chucked on the transfer drum 8 one by one. Then the copying paper on which the four color images have been superposed is conveyed to the fixing device 16.

In the monocolor mode, only single color of cyan, magenta, yellow or black respectively is transferred to the copying paper, then to be fixed in accordance with the predetermined mode. Or it includes the modes in which only yellow and magenta are superposed on the copying paper to be fixed as red (R), only cyan and yellow to have green (G) or only magenta and cyan for blue (B).

To be sure, this invention will be effective not only in the full color mode but in all image modes, even such monocolor modes as mentioned above, in the case where plural of toners take part in producing any color.

A confirmation experiment has been carried out, using the four colors of toners of the aforementioned example. The conditions therefor were set as follows:

Developer: Two-component type

Carrier: F141-300 (made by Powdertech K.K.)

Toner concentration: 6%.

Environmental conditions: H/H, N/N, L/L (high temp./high humidity, normal temp./normal humidity, low temp./low humidity)

Image stabilizing method: The adhesion amount of the yellow toner on the photosensitive member is detected, to compare it with a standard one. With respect to the standard amount, the developing potential difference $\Delta V$ was adjusted so as to make the maximal adhesion amount of the yellow toner on the paper constant at 0.8 mg/cm$^2$ in any environmental conditions. In this machine, for which the reversal development is adopted, $\Delta V$ was controlled by altering the developing electrode bias (Vb).

Figure 8:
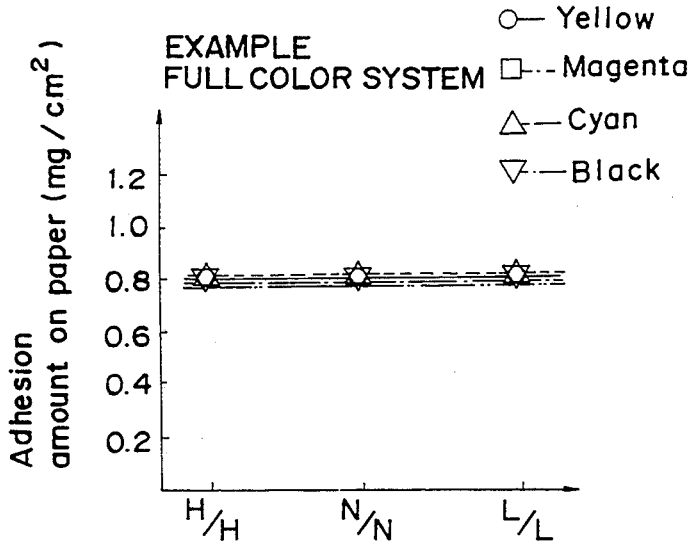
FIG. 8 shows results of measurement of the amount of electrification in respective environmental conditions.

The data of $\Delta V$ obtained for the yellow toner was applied to the conditions for toners of other colors. The results are shown in FIG. 8. FIG. 8 clearly demonstrates that toners of respective colors gave quite stable adhesion amount under respective environmental conditions. From this it was confirmed that the toners of respective colors undergo equal variations in the amount of electrification under any environmental conditions.

This results assures that when full color images are formed or when images are formed under any monocolor mode by use of any toners of this invention, copy images are obtainable which give no deviating adhesion amount in each color, but which are true to the images of the manuscript. Further toners of different colors containing different coloring agents show equal fluctuations in the amount of electrification. The adhesion amount of each color toner is stable.

Example 2

In developers of other forms, toner mixtures for desired colors may be obtained by mixing various color toners. For example, by mixing yellow and magenta toners, a mixed toner of red may be obtained; from yellow and cyan toners, green; and from magenta and cyan, blue. Further, a metallic toner may be mixed to give metallic tone. Besides, by mixing these toners in various proportions, mixed toners of desired colors may be obtained.

The preferred embodiments will be particularly described:

Yellow, magenta and cyan toners used in this embodiment are identical with those described in Example 1. Only the black toner is different from that of Example 1.

The three color toners were taken respectively in the same proportion and put in a mixer to be mixed together, yielding a black toner for use of full color.

This black toner was mixed with a carrier (F141-300; made by Powdertech K.K) to have 8% toner concentration. The developer of black was taken into the developing machine **20*d* in a full color copying machine CF-70 (made by Minolta Camera K.K.). Each developer of yellow, magenta or cyan was taken into the developing machines 20*a*, 20*b* and 20*c*** in a manner similar to Example 1.

The running test with this system was done with 15000 sheets of paper to form full color copy images based on color manuscript images. Fine fogless images could be maintained.

Comparative Example 2

A colored matter was obtained by melt and kneading the undermentioned materials:

| | |
|---|---|
| Resin for binder | |
| Styrene-maleic anhydride copolymer (the same as the resin used as the matrix resin in the aforementioned Example) | 100 pbw |
| Charge controlling agent | |
| Bontron E-81 (made by Orient Kagaku K.K.) | 3 pbw |
| Coloring agent | |
| Lionol Yellow FG-1310 (made by Toyo Ink Seizo K.K.) | 3 pbw |

The colored matter thus obtained was finely pulverized by a jet mill, followed by classification, to give a yellow toner having average particle diameter of 11 μm.

Then by use of the coloring agents below, magenta, cyan and black toners having average particle diameter of 11 μm were obtained:

-continued

| | |
|---|---|
| Magenta toner | |
| Lionol Red 6B FC-4213 (made by Toyo Ink Seizo K.K.) | 3 pbw |
| Cyan toner | |
| Lionol Blue G-7350 (made by Toyo Ink Seizo K.K.) | 3 pbw |

Since in the above three color toners, respective coloring agents are exposed at the toner surfaces, the materials appearing on the surfaces are different in each toner.

A black toner for use of full color was obtained by putting the above three color toners into a mixer respectively in equal proportion.

This toner was mixed with a carrier (F141-300; made by Powdertech K.K.) to have 8% toner concentration. The mixture was then charged into a full color copying machine CF-70 (made by Minolta Camera Co., Ltd.) similarly as in Example 2, to perform a running test. From the beginning heavy fogging occurred. It was impossible to put the developer into practical use.

Example 3 (red toner)

A red toner was obtained by taking the yellow and magenta toners obtained in Example 1 in equal proportion into a mixer and mixing them together.

This toner was mixed with a carrier of binder type (made by Minolta Camera K.K.) to have toner concentration of 8%. Then the mixture was taken into a copying machine EP-5400 (made by Minolta Camera K.K.) to be subjected to a running test of 15000 sheets. Fogless fine image were kept.

Figure 9:
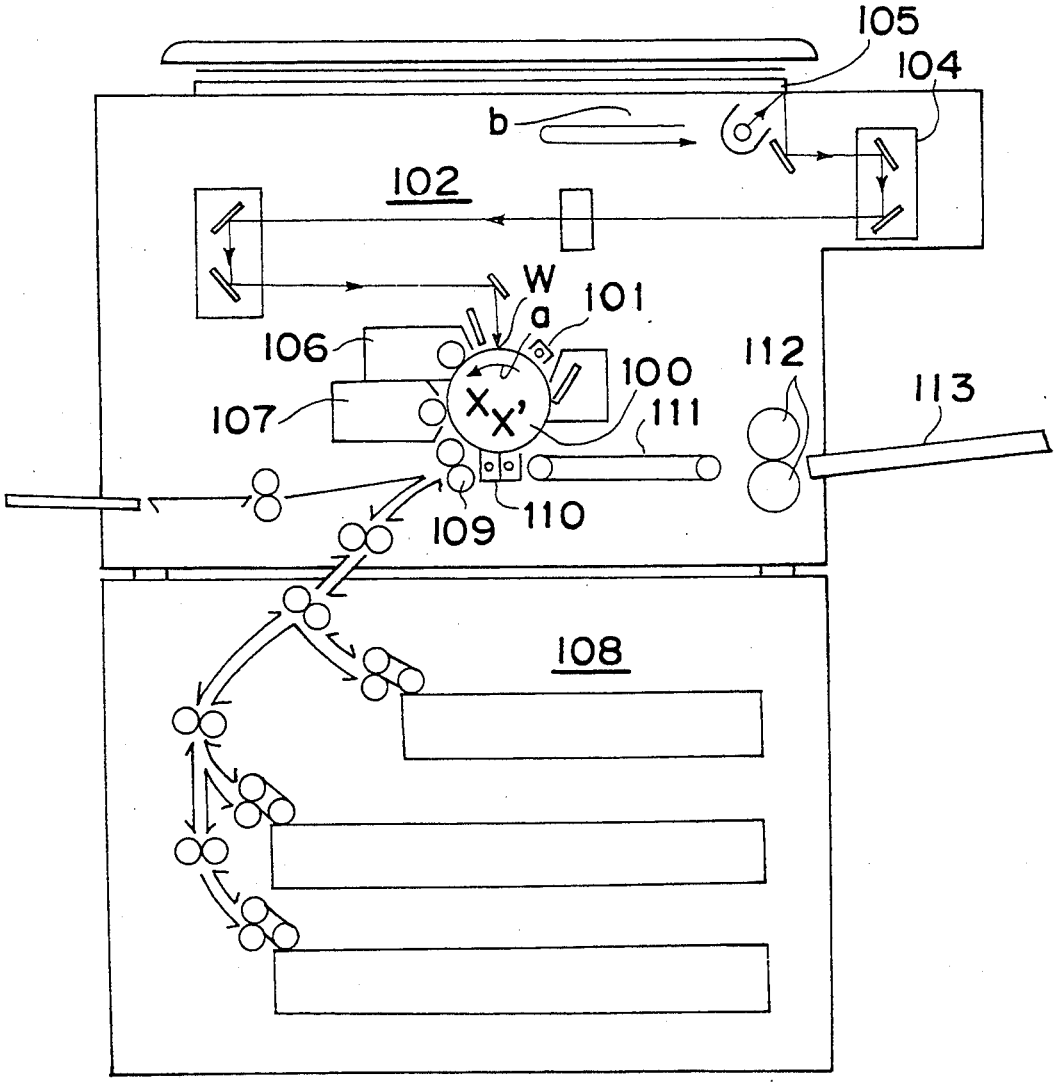
FIG. 9 is a schematic sectional view of a copying machine capable of simultaneous two-color copying.

In the following, some explanation will be taken on FP5400:

FIG. 9 is a schematic sectional view of a copying machine capable of making two-color copy simultaneously. The standard copying operation is explained to reproduce the manuscript image as it is by referring to FIG. 9.

First in the state of a photosensitive drum 100 turning in the direction of an arrow (a), a definite electrical charge is given on the photosensitive drum 100 by the discharge of the electrification charger 101.

Then while a scanner 104 having an exposure lamp 103 in an optical system 102 is scanned in the direction of an arrow (b) to irradiate a manuscript mounted on a manuscript mounting glass 105. The surface of the photosensitive drum 100 is exposed to the reflected light at the exposing area W through mirrors and lenses, whereby a static latent image is formed thereon in correspondence with the manuscript image. This electrostatic latent image is turned into a visible image by the toner supplied at the developing region X or X' facing the following first developing unit 106 or second developing unit 107, whereby a toner image reproducing the manuscript image is formed.

Copying paper is selectively fed from a feeding unit 108 and conveyed to the part facing a transfer charger 110, with the timing adjusted to the toner image on the photosensitive drum 100 by means of a pair of timing rollers 109. The toner image is transferred to the copying paper. The copying paper is carried between a pair of fixing rollers 112 by transporting unit 111, where the toner image is melt to be fixed on the copying paper. The paper is then discharged to the delivery section 113.

The first developing unit 106 and the second developing unit 107 are removable in the copying machine. They are exchangeable with developing units of the same type containing different colored developers. These developing units 106 and 107 are designed to be exchangeable with a black developing unit containing a developer comprising the black toner and a carrier, a red developing unit containing a developer comprising the aforementioned red toner and a carrier or other color developing units containing developers comprising each color toner and a carrier.

In this example, the developing machine is so composed that its first unit is not operated and that its second unit only is operated. In Example 3, the black toner in the first developing unit is not particularly defined, but the toners in the first developing unit may be assumed to have their surfaces in the same state as the toner in the second developing unit.

While in this example 3, a red toner is described, a blue toner may be obtained by mixing the magenta toner with the cyan toner obtained in Example 1, and a green toner by mixing cyan and yellow toners.

Comparative Example 3

The yellow and magenta toners obtained in Comparative Example 2 were taken in the same proportion into a mixer to give a red toner.

This toner was mixed with a binder carrier (made by Minolta Camera K.K.) to have toner concentration of 8%. Then a running test was done with this developer charged into a copying machine EP-5400 (made by Minolta Camera K.K.) similarly as in Example 3. Its practical use was impossible because heavy fogs are formed from the beginning.

Example 4 (Metallic Blue Toner)

Forty two pbw of the domain resin prepared in Example 1 and 3 pbw of Pearl pigment (Iriodin 100 Silver Pearl; made by Merck K.K. ) were melt and kneaded in a twin extruder.

Next 52 pbw of the matrix resin prepared in Example 1 and 3 pbw of a charge controlling agent (Bontron E-81; made by Orient Kagaku K.K.) were melt and kneaded in a twin extruder.

Then 45 pbw of the kneaded domain resin, 55 pbw of the kneaded matrix resin and 8 pbw of a dispersing assistant were melt and kneaded in a twin extruder to give a metallic composition.

Part of this metallic composition was sandwiched between a slide glass and a cover glass and turned into a thin film by heat fusion on a hot press. As this film was observed under an optical microscope of transmission type, existence of a dispersion phase colored with a metallic tone was observed. The dispersion phase had particle diameters ranging from 40–80 μm and was uniformly and finely dispersed in the matrix. The Pearl pigment was not found in the matrix and the charge controlling agent was present only in the matrix.

The obtained metallic composition in this way was finely pulverized by a jet mill and then classified, to give a metallic toner having average particle diameter of 100 μm.

The magenta and cyan toners prepared in Example 1 and the metallic toner were put into a mixer in a proportion of 1:1:2, to be mixed together, giving a metallic blue toner.

The toner thus obtained was mixed with a carrier of binder type (made by Minolta Camera K.K.) to have toner concentration of 8%. This mixture was put into a copying machine EP-5400 (made by Minolta Camera K.K.). The running test of 150000 sheets was done similarly as in Example 3. A fine fogless image was maintained.

While in this example, a metallic blue toner was described, a metallic green toner may be obtained by mixing the cyan and yellow toners prepared in Example 1 with the metallic toner, and a metallic red toner by mixing the yellow and magenta toners with the metallic toner.

Comparative Example 4

A metallic composition was obtained by melting and kneading the materials below:

| | |
|---|---|
| Resin as a binder | |
| Styrene/maleic anhydride copolymer (the same resin as the matrix resin in the above example) | 100 pbw |
| Charge controlling agent | |
| Bontron E-81 (made by Orient Kagaku K.K.) | 3 pbw |
| Coloring agent | |
| Iriodin 100 Silver Pearl (made by Merck K.K.) | 3 pbw |

The metallic composition then obtained was finely pulverized by a jet mill, followed by classification to give a metallic toner having average particle diameter 11 μm.

A metallic blue toner was obtained by putting the magenta and cyan toners prepared in Example 1 and the aforementioned metallic toner into a mixer in a proportion of 1: 1: 2.

The toner thus obtained was mixed with a binder carrier (made by Minolta Camera K.K.), to have toner concentration of 8%. Then a running test of 15000 sheets was performed with this mixture put into a copying machine EP-5400 (made by Minolta Camera K.K.) similarly as in Example 3. Heavy fogging occurred from the beginning. The metallic blue toner can not taken into practical use.

Example 5

In the following, black toners preferable according to this invention are illustrated.

The same domain and matrix resins and dispersing assistant as employed in Example 1 were used.

Fifty pbw of the domain resin, 3 pbw of an organic pigment Lionol Yellow FG-1310 (made by Toyo Ink Seizo K.K.), 6 pbw of another organic pigment Lionol Red 6B FG-4213 (made by Toyo Ink Seizo K.K.) and 6 pbw of an further organic pigment Lionol Blue FG-7350 (Toyo Ink Seizo K.K.) were melt and kneaded in a twin extruder.

Sixty pbw of this kneaded material, 40 pbw of the matrix resin and 8 pbw of the dispersing assistant were melt and kneaded to give a colored composition.

Part of this colored composition was sandwiched between a slide glass and a cover glass, to turn it into a thin film through its heat fusion on a hot press. Observation of this film under an optical microscope of transmission type revealed that a colored dispersion phase is present with its particle diameters ranging from 0.5–1.0 μm and that this dispersion phase was uniformly and finely dispersed in the matrix. No coloring agent was seen in the matrix.

The colored matter thus obtained was finely pulverized by a jet mill, followed by classification, to give a toner having average particle diameter of 11 μm. Its classified yield at this time was 91%.

Example 6

A colored composition was obtained similarly as in Example 5, except that use was made of 90 pbw of a kneaded matter which was obtained by melting and kneading in a twin extruder 50 pbw of the domain resin, 8 pbw of an organic pigment Lionol Yellow FG-1310 (made by Toyo Ink Seizo K.K.), 16 pbw of another organic pigment Lionol Red 6B FC-4213 (made by Toyo Ink Seizo K.K.) and 16 pbw of a further organic pigment Lionol Blue FG-7350 (made by Toyo Ink Seizo K.K.).

As this composition was evaluated in the similar way, it turned out to be in the same dispersed state as that of Example 1. Further the classified yield was 87%, which was equal to that in Example 1.

Further 1.0% by weight of hydrophobic titanium (T805; made by Nihon Aerosil K.K.) and 0.2% by weight of hydrophobic silica (H2000/4) were added to each toner of Examples 5 and 6 to be mixed in a Henschel mixer. This mixture and a ferrite carrier (F141-300; made by Powdertech K.K.) were mixed in a proportion of 8:92, to give a developer. Then its amount of electrification was measured.

The amount of electrification of each toner was measured by a blow-off electrification measuring instrument. Its amount of electrification after leaving it under high temperature (30° C.) and high humidity (85% RH) for 12 hr and that after leaving it at 45° C. for 1 month were measured.

The results are summarized in Table 1.

TABLE 1

| | Characteristics of respective toners | | | |
|---|---|---|---|---|
| | | Electrification performance | | |
| | Electric resistance | Initial amount of electrification | After leaving at 30° C., 85% for 12 hr | After leaving at 45° C., for 1 month |
| Example 5 | More than $10^{15}$ | −20 μc/g | −19 μc/g | −19 μc/g |
| Example 6 | $10^{15}$ | −19 | −18 | −16 |

Similarly as in Example 1, the developers prepared as described hereinabove were put in a full color copying machine (CF-70; made by Minolta Camera K.K.) to be subjected to a durability test of 7000 sheet.

The toners of Examples 5 and 6 showed no tendency of forming fogs on the ground and gave a degree of blackness which was quite high and which had no bluish tint.

The black toner for use of full color is excellent in environmental stability in its electrification characteristic, printing resistance and keeping stability.

What is claimed is:

1. A developer comprising plural toners used for an image-forming method of forming images cyclically with the plural toners used in a successive order characterized in that said toners comprise a first toner and a second toner:

said first toner comprising a matrix resin component, domain resin components containing a first coloring agent and being dispersed in the matrix resin component, and a dispersion assistant component having a compatibility with the domain resin components and matrix resin component and existing between the domain resin components and the matrix resin component such that the matrix resin component encapsulates the combination of said domain resin components and said dispersion assistant component;

said second toner comprising a matrix resin component, domain resin components containing a second coloring agent and being dispersed in the matrix resin component, and a dispersion assistant component having a compatibility with the domain resin components and matrix resin component and existing between the domain resin components and the matrix resin component such that the matrix resin component encapsulates the combination of said domain resin components and said dispersion assistant component; and the matrix resins of said first and second toners being made of the same resin.

2. A developer of claim 1 wherein the dispersion assistant component has an Izod impact value higher than that of the matrix resin.

3. A developer of claims 1, in which the domain resin component is contained at a content of 1 percent by weight or more on the basis of the total amount of toner.

4. A developer of claims 1, 2 or 3 in which each toner has a mean particle diameter of 5–20 μm.

5. A developer of claim 1, wherein the plural toners further comprise a third toner which comprises a matrix resin component being made of the same resin as the matrix resin component of the first and second toners, domain resin components containing a third coloring agent and being dispersed in the matrix resin component, and a dispersion assistant component having a compatibility with the domain resin components and matrix resin component and existing between the domain resin components and the matrix resin component.

6. A developer of claim 5, wherein the plural toners comprise a cyan toner, a magenta toner and a yellow toner.

7. A developer of claim 5, wherein the plural toners further comprise a fourth toner which comprises a matrix resin component being made of the same resin as the matrix resin component of the third toner, domain resin components containing a fourth coloring agent and being dispersed in the matrix resin component, and a dispersion assistant component having a compatibility with the domain resin components and matrix resin component and existing between the domain resin components and the matrix resin component.

8. A developer of claim 7, wherein the plural toners comprise a cyan toner, a magenta toner, a yellow toner and a black toner.

9. A toner comprising a mixture of a first toner and a second toner;

said first toner comprising a matrix resin component, domain resin components containing a first coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant components;

said second toner comprising a matrix resin component, domain resin components containing a second coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant components; and the matrix resins of said first and second toners being made of the same resin.

10. A toner of claim 9, which is black.

11. A toner of claim 9, wherein the dispersion assistant component has an Izod impact value higher than of the matrix resin.

12. A toner comprising a matrix resin component, domain resin components containing plural coloring agents and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant component.

13. A toner of claim 12, wherein the plural coloring agents are a mixture of the three coloring agents, cyan, magenta and yellow.

14. A full color image-forming method which utilizes the toner of claim 13 as a black toner.

15. A toner of claims 12 or 13, in which the domain resin component is contained at a content of 1 percent by weight or more on the basis of the total amount of toner.

16. A toner of one of claims 9 or 12, in which each toner has a mean particle diameter of 5–20 μm.

17. An image-forming method comprising a first step of forming a toner image on a recording medium by use of a first toner and a second step of forming another toner image on the recording medium by use of a second toner;

said first toner comprising a matrix resin component, domain resin components containing a first coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant component;

said second toner comprising a matrix resin component, domain resin components containing a second coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant component; and the matrix resins of said first and second toners being made of the same resin.

18. An image-forming method of claim 17, wherein the dispersion assistant component has an Izod impact value higher than that of the matrix resin.

19. An image-forming method of claim 17, in which the first toner is a yellow toner and the second toner is a magenta toner.

20. An image-forming method of claim 17, in which the first toner is a cyan toner and the second toner is a yellow toner.

21. An image-forming method of claim 17, in which the first toner is a magenta toner and the second toner is a cyan toner.

22. An image-forming method of claim 17, which further comprises a third step of forming a toner image on the recording medium by use of a third toner, said third toner comprising a matrix resin component being made of the same resin as the matrix resin component of the first and second toners, domain resin components containing a third coloring agent and being dispersed in the matrix resin component, and a dispersion assistant component having a compatibility with the domain resin components and matrix resin component and existing between the domain resin components and the matrix resin component.

23. An image-forming method of claim 22, which further comprises a fourth step of forming a toner image on the recording medium by use of a fourth toner, said forth toner comprising a matrix resin component being made of the same resin as the matrix resin component of the third toner, domain resin components containing a fourth coloring agent and being dispersed in the matrix resin component, and a dispersion assistant component having a compatibility with the domain resin components and matrix resin component and existing between the domain resin components and the matrix resin component.

24. An image-forming method which comprises a first step of transferring to a recording medium by dint of electrostatic force a first toner and a second step of transferring to the recording medium by dint of electrostatic force a second toner;

said first toner comprising a matrix resin component, domain resin components containing a first coloring agent and being dispersed in the matrix resin component, and a dispersioon assistant component having a compatibility with the domain resin components and matrix resin component and existing between the domain resin components and the matrix resin component such that said matrix resin component encapsulates the combination of said domain resin components and said dispersion assistant component;

said second toner comprising a matrix resin component, domain resin components containing a second coloring agent and being dispersed in the matrix resin component, and a dispersion assistant component having a compatibility with the domain resin coonents and matrix resin component and existing between the domain resin components and the matrix resin component such that said matrix resin component encapsulates the combination of said domain resin components and said dispersion assistant component; and the matrix resins of said first and second toners being made of the same resin.

25. An image-forming method of claim 24, wherein the dispersion assistant component has an Izod impact value higher than that of the matrix resin.

26. An image-forming method of claim 24, which further comprises a third step of transferring to the recording medium by dint of electrostatic force a third toner, said third toner comprising a matrix resin component being made of the same resin as the matrix resin component of the first and second toners, domain resin components containing a third coloring agent and being dispersed in the matrix resin component, and a dispersion assistance component having a compatibility with the domain resin components and matrix resin component and existing between the domain resin components and the matrix resin component.

27. An image-forming method of claim 26, which further comprises a fourth step of transferring to the rcording medium by dint of electrostatic force a fourth toner, said fourth toner comprising a matrix resin component being made of the same resin as the matrix resin component of the third toner, domain resin comoponents containing a fourth coloring agent and being dispersed in the matrix resin component, and a dispersion assistant component having a compatibility with the domain resin coponents and matrix resin component and existing between the domain resin components and the matrix resin component.

28. An image-forming method comprising;

a first step of forming a first toner image on an intermediate recording medium by use of a first toner which comprises a matrix resin component, domain resin components containing a first coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant component;

a second step of superposing a second toner image on the first toner image formed on the intermediate recording medium by use of a second toner which comprises a matrix resin component being the same resin of the matrix resin component of the first toner, domain resin components containing a second coloring agent and being dispersed in the matrix resin component, and a dispersion assistant component having a compatibility with the domain resin components and matrix resin component and existing between the domain resin components and the matrix resin component such that said matrix resin component encapsulates the combination of said domain resin components and said dispersion assistant component; and a step of transferring by dint of electrostatic force onto a recording medium the superposed toner images formed on the intermediate recording medium.

29. An image-forming method of claim 28, which further comprises a third step of superposing a third toner image on the first and second toner images formed on the intermediate recording medium by use of a third toner which comprises a matrix resin component being made of the same resin as the matrix resin component of the first and second toners, domain resin components containing a third coloring agent and being dispersed in the matrix resin component, and a dispersion assistant component having a compatibility with the domain resin components and matrix resin component and existing between the domain resin components and the matrix resin component.

30. An image-forming method of claim 29, which further comprises a fourth step of superposing a fourth toner image on the first, second and third toner images formed on the intermediate recording medium by use of a fourth toner which comprises a matrix resin component being made of the same resin as the matrix resin component of the third toner, domain resin components containing a fourth coloring agent and being dispersed in the matrix resin component, and a dispersion assistant component having a compatibility with the domain resin components and matrix resin component and existing between the domain resin components and the matrix resin component.

* * * * *